US005176272A

United States Patent [19]

Ryan

[11] Patent Number: 5,176,272

[45] Date of Patent: Jan. 5, 1993

[54] CONTAINER FOR SPOOLED MATERIALS

[75] Inventor: Richard J. Ryan, Marietta, Ga.

[73] Assignee: United Plastic Films, Inc., Atlanta, Ga.

[21] Appl. No.: 698,918

[22] Filed: May 13, 1991

Related U.S. Application Data

[63] Continuation-in-part of Ser. No. 674,037, Mar. 25, 1991.

[51] Int. Cl.[5] ..... B65D 1/34

[52] U.S. Cl. ..... 220/4.23; 206/509; 206/389

[58] Field of Search ..... 206/509, 407, 389; 220/4.23, 4.24

[56] References Cited

U.S. PATENT DOCUMENTS

| | | | |
|---|---|---|---|
| D. 155,271 | 9/1949 | Collard et al. . | |
| 1,332,386 | 3/1920 | Dwyer . | |
| 2,276,414 | 3/1942 | Morehouse et al. . | |
| 3,128,025 | 4/1964 | Buttery et al. . | |
| 3,283,992 | 11/1966 | Hanson et al. | 206/509 |
| 3,511,433 | 5/1970 | Andrews et al. | 220/4.23 |
| 3,616,943 | 11/1971 | Brink | 206/509 |
| 3,627,514 | 1/1987 | Kildea et al. . | |
| 3,786,982 | 1/1974 | Rakes et al. . | |
| 3,893,609 | 7/1975 | Jamois et al. . | |
| 3,937,389 | 2/1976 | Wind | 220/4.23 |
| 4,034,926 | 7/1977 | Wegner . | |
| 4,139,093 | 2/1979 | Holmes | 220/4.23 |
| 4,191,307 | 3/1980 | LeClaire, Jr. et al. . | |
| 4,384,664 | 3/1983 | Roos . | |
| 4,576,330 | 3/1986 | Schepp . | |
| 4,850,486 | 7/1989 | Neibaur . | |

FOREIGN PATENT DOCUMENTS 3916668 12/1989 Fed. Rep. of Germany ..... 220/4.23

OTHER PUBLICATIONS

Several photographs of a container for Dustbin Liners purchased at Mark & Spencer, London, England in Aug. 1990, manufactured by T. Gould Ltd., Lancashire, England.

*Primary Examiner*—Joseph Man-Fu Moy
*Attorney, Agent, or Firm*—Kilpatrick & Cody

[57] ABSTRACT

A container for spooled materials comprising: an upper half having at least one generally flat, corrugated rest, an upper flange and a label display surface having a rounded upper portion and a substantially flat, substantially vertical, lower portion; a lower half having a generally flat, corrugated base, at least one end flange and a base-widening lower flange having a base-widening edge extending along the length of the lower half substantially parallel to the base; a hinge joining the upper half with the lower half; and a means for maintaining the upper flange in contact with the end flange so as to define a cavity within the container comprising at least one indentation in the upper flange that nests within at least one indentation in the end flange.

21 Claims, 2 Drawing Sheets

CONTAINER FOR SPOOLED MATERIALS

BACKGROUND OF THE INVENTION

This application is a continuation-in-part application of application Ser. No. 07/674,037, filed Mar. 25, 1991, entitled "Container and Dispenser," which is incorporated herein by reference.

This invention relates to packaging for spooled materials such as plastic trash bags, plastic films, aluminum foil, wax paper and the like. These materials, being cylindrical, are difficult to stack in multiple layers on store shelves and are also difficult to package so that the product and product labels can be seen easily when the materials are so stacked. Prior to the present invention, several methods were used to package and stack these spooled materials.

For example, some packaging consists of a clear plastic bag sealed either hermetically or mechanically. While this packaging method allows the material to be stacked on end, such a configuration is inherently unstable due to the relatively high center of gravity of the packaged material. In addition, when the spool is small in diameter, the vertical configuration of the package results in only a narrow, vertical rectangle upon which to display the product label to passing viewers. Furthermore, typical store shelves are placed close together. When the spooled materials are packaged in vertical containers, no more than two or three layers will fit on the shelf.

Other containers, such as cardboard boxes that open in a clamshell-like fashion, can be stacked in multiple layers with the material in a stable, horizontal configuration. This type of packaging allows the product label to be displayed more prominently. However, cardboard boxes of this type are generally opened by tearing off a removable strip along one side of the box and cannot be resealed once opened. Furthermore, cardboard boxes are opaque and do not allow the purchaser to view the material inside prior to purchase.

Still other containers are formed from thin, clear thermoplastic, are generally cylindrical in shape, open in a horizontal, clamshell-like fashion, have flanges with nesting indentations and a corrugated, flat base along the length of the container. The use of nesting indentations allows the container to be resealed once open and the clear thermoplastic allows purchasers to view the material inside prior to purchase. Furthermore, the flat base helps the container resist rolling when placed on its side on a store shelf. However, these clear thermoplastic containers have several disadvantages.

For example, the rounded top found on these containers prevents stacking the containers one on top of the other in multiple layers and only a single layer may be placed on a shelf in a stable manner. In addition, the horizontal clamshell design and rounded top require any product label used on the container to be placed on the rounded top surface that tilts the label away from the viewer and results in a portion of the label being upside down. Furthermore, the narrow, corrugated base, while helping the container resist rolling, is not very stable and the container is easily upset.

BRIEF SUMMARY OF THE INVENTION

The present invention improves prior art containers by providing a clear plastic container having two generally semi-circular halves joined longitudinally along a continuous hinge to form a hollow cylinder.

The bottom half of the container has a corrugated, flattened base along its length and the top half contains two small, corrugated flattened rests at either end. The base and rests are positioned opposite and parallel to each other in a generally horizontal orientation when the container is placed on a shelf so that the container opens in a clamshell-like fashion along a plane that is approximately 45° from vertical.

A wide flange extends around the periphery of each half from each end of the hinge. Four pairs of elongated indentations are formed in the ends of the flange so that when the halves are pressed together, the indentations in the flange of the top half nest in the indentations in the flange of the bottom half, thereby holding the halves together in a closed position. The flange along the length of the bottom half opposite the hinge terminates at a point that is substantially horizontal with the base and defines a base-widening leg along the length of the container.

The upper half contains a label display surface located between the small, corrugated, flattened rests that extends from the hinge and generally follows the semi-circular circumference of the upper half until reaching the vertical tangent of the semi-circle, at which point the display surface peels away from the cylinder, becoming a vertical plane that terminates along a line that generally aligns with the edge of the lower longitudinal flange. The intersection of the edge of the lower flange and the lower edge of the label surface defines a dispensing guide for the spooled material within the container which made be used to tear off a length of the material.

DETAILED DESCRIPTION OF THE DRAWINGS

Figure 1:
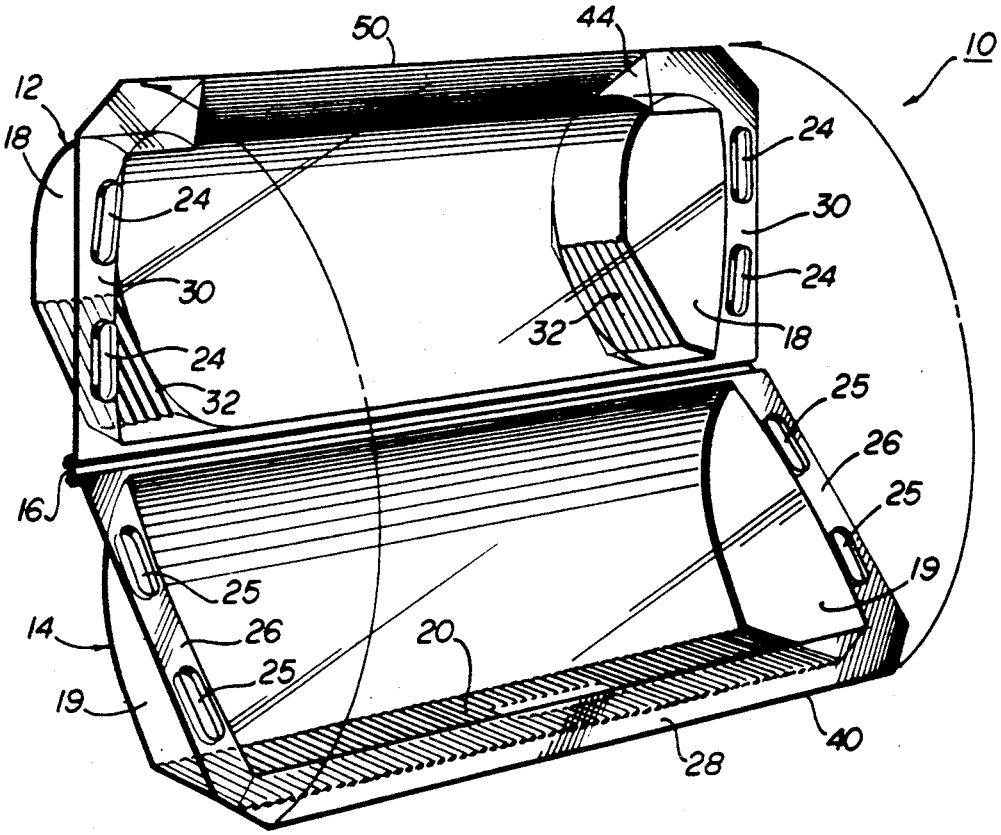
FIG. 1 is a perspective view of the container of the present invention with the upper half in an opened position.
Figure 2:
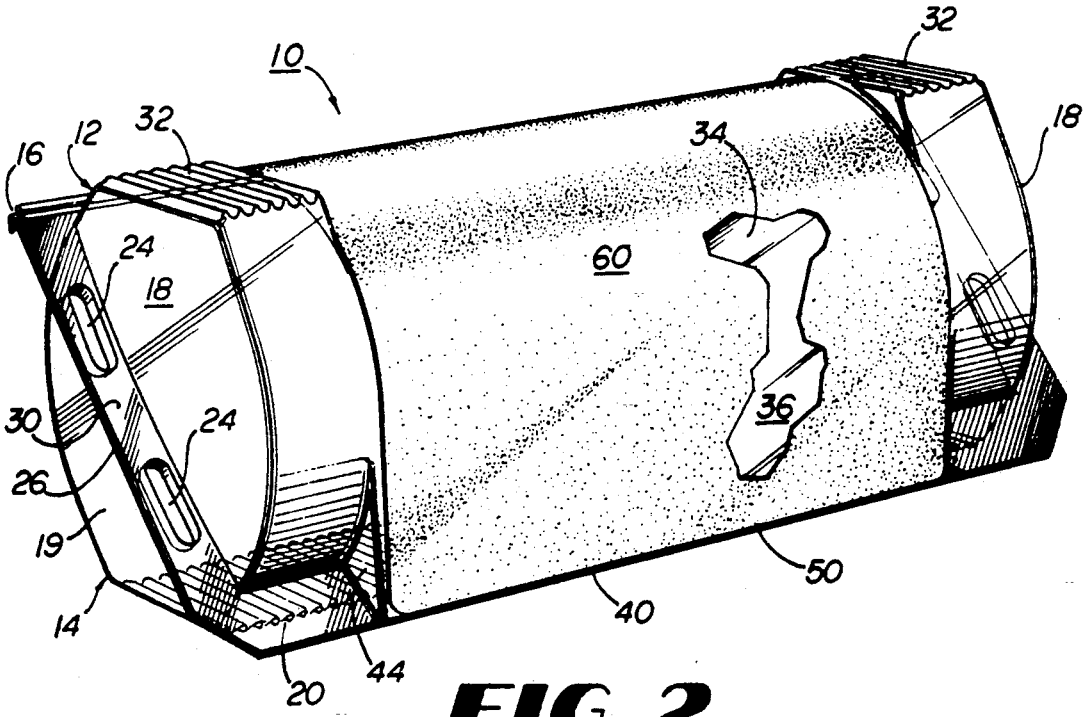
FIG. 2 is a perspective view of the container of the present invention similar to FIG. 1 but with the upper half in a closed position.
Figure 3:
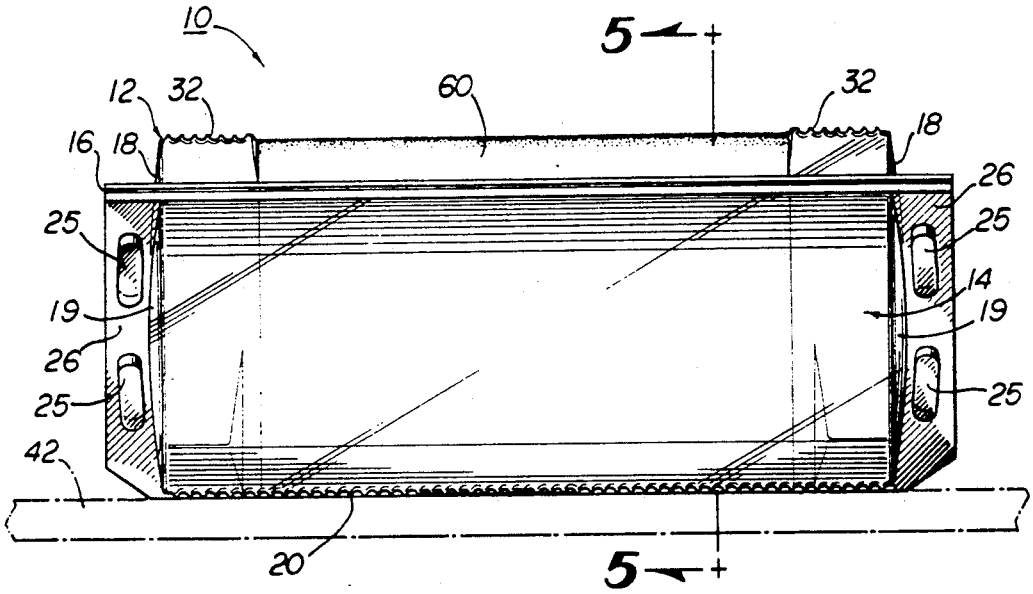
FIG. 3 is a front elevational view of the container shown in FIG. 2.

As can be seen in FIGS. 1, 2 and 3, container 10 generally comprises semi-circular upper half 12 and lower half 14 joined along one longitudinal side by hinge 16 to form a cylinder having a cavity 13. Lower half 14 contains planar, corrugated base 20 substantially along the entire length of lower half 14 and upper half 12 contains two small, planar, corrugated rests 32 at either end 18 of upper half 12 generally parallel to and opposite base 20. Corrugated rests 32 are separated by label surface 34, which generally follows the semi-circular contour of upper half 12 except for lower section 36 which is vertically tangential to upper half 12. Container 10 is preferably made of injection molded or thermoformed clear polyethylene terephthalate and may be approximately 0.012" to 0.022" thick, with 0.015" being preferred, but other colors, plastics and thicknesses can also be used.

Lower half 14 contains longitudinal flange 28, which is appended perpendicularly from lower half 14 and extends along front edge 38 of lower half 14 opposite hinge 16, and end flanges 26, which are appended perpendicularly from ends 19 of lower half 14 between longitudinal flange 28 and hinge 16 and contain elongated indentations 25. Upper half 12 contains end flanges 30, which are appended perpendicularly from ends 18 of upper half 12 between hinge 16 and lower tangential section 36 of label surface 34 and contain indentations 24.

Upper half 12 and lower half 14 are joined in a closed positions, as illustrated in FIGS. 2, 3, 4 and 5, by elongated indentations 24 and 25. Indentations 24 and 25 are identical in size and shape and are placed on end flanges 30 and 26, respectively, so that indentations 24 frictionally engage and nest within indentations 25 when halves 12 and 14 are rotated about hinge 16 until end flanges 30 contact end flanges 26 and longitudinal flange 28 contacts lower edge 50 of the tangential section 36, thereby holding halves 12 and 14 in a closed position. To place container 10 in an open position as illustrated in FIG. 1, indentations 24 are disengaged from indentations 25 and halves 12 and 14 counter-rotated about hinge 16.

Container 10 is prevented from rolling on a horizontal surface by base 20 acting in combination with longitudinal flange 28. Base 20 is located around the circumference of lower half 14 so that when base 20 is placed on a flat, horizontal surface, such as shelf 42, end flanges 26 are at an angle of approximately 45° from vertical and lower edge 40 of longitudinal flange 28 is substantially even with base 20. While the width of base 20 is sufficient to stabilize container 10, the simultaneous use of longitudinal flange 28 effective widen container 10 and imparts additional stability.

Figure 4:
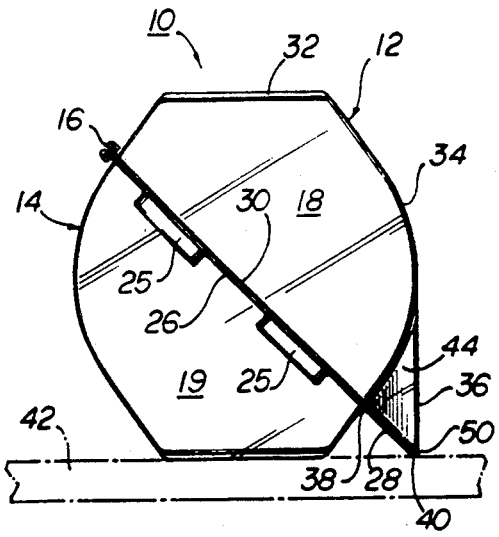
FIG. 4 is a side elevational view of the container shown in FIG. 1 and similar to FIG. 3 except the container has been rotated 90°.

Containers 10 may be stacked, one on top of another, through the interaction of base 20 and rests 32. As can be seen in FIGS. 3 and 4, rests 32 are located around upper half 12 so that rests 32 are parallel with base 20 and substantially horizontal when container 10 is placed on a horizontal surface such as shelf 42. In use, a second container (not shown) is placed on top of container 10 so that the base of the second container (not shown) sits on rests 32 of container 10. The corrugations of rests 32, in addition to stiffening top half 12, engage the corrugations of the base of the second container (not shown), so that the second container (not shown) sits in a stable condition on container 10 and resists being dislodged.

Container 10 also contains label surface 34 on top half 12. Label surface 34 generally follows the semi-circular contour of upper half 12 for approximately 120°, at which point lower section 36 of label surface 34 peels away from upper half 12 to form a plane that is tangential to upper half 12 and generally vertical when container 10 is placed on shelf 42. Triangular gussets 44, which strengthen top half 12, are formed by the intersection of end flanges 30, lower section 36 and top half 12. Label surface 34, including lower sections 36, allows product label 60 to be easily seen when multiple containers 10 are stacked one on top of the other in the manner described above.

Figure 5:
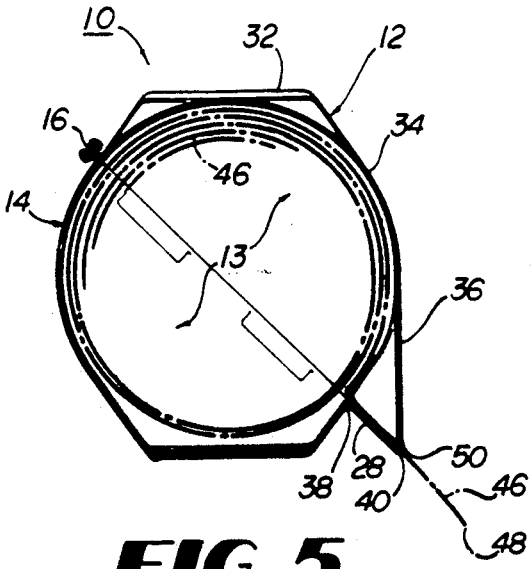
FIG. 5 is a cross section of the container of the present invention taken along line 5—5 in FIG. 3 and showing a roll of spooled material within the container.

As can be seen in FIG. 5, in use, container 10 is opened and spooled material 46 is placed within cavity 13. Container 10 is closed with indentations 24 engaged with indentations 25 so that the free end 48 of material 46 exits container 10 between lower edge 40 of longitudinal flange 28 and lower end 50 of tangentail section 36. Material 46 can then be torn off at the desired length or at precut perforations (not shown) in material 46 by use of edge 40 or edge 50.

This description is given for purposes of illustration and explanation. It will be apparent to those skilled in the relevant art that changed and modifications may be made to the invention described above without departing from its scope or spirit.

I claim:

1. A container for spooled materials comprising:

a) an upper half having at least one generally flat, corrugated rest and an upper flange;

b) a lower half having a generally flat, corrugated base and a lower flange;

c) a hinge joining the upper half with the lower half; and d) a means for maintaining the upper flange in contact with the lower flange so as to define a cavity within the container, wherein a portion of the lower flange has a base-widening edge that is substantially parallel with the hinge and in the same plane as the base, said base-widening edge being sized to impart additional stability to the container when the container is sitting on a surface.

2. The container of claim 1 wherein the maintaining means comprises at least one identification in the upper flange that nests within at least one indentation in the lower flange.

3. The container of claim 1 further comprising a label surface on the upper half having an interior and an exterior, a rounded upper portion and a substantially planar lower portion tangential to the rounded upper portion.

4. The container of claim 3 further comprising a label positioned on the exterior of the label surface.

5. The container of claim 3 wherein the container is comprised of clear thermoplastic and a label is positioned on the interior of the label surface.

6. The container of claim 1 wherein the container is comprised of thermoplastic.

7. The container of claim 6 wherein the thermoplastic is polyethylene terephthalate.

8. The container of claim 7 wherein the polyethylene terephthalate is clear.

9. The container of claim 3 wherein the container is comprised of clear thermoplastic and a label is positioned on the exterior of the label surface.

10. The container of claim 7 wherein the thermoplastic is between approximately 0.012 and 0.022 inches thick.

11. The container of claim 1, wherein the hinge and lower flange are positioned substantially opposite and parallel to each other along a plane that is approximately 45° from vertical.

12. A container for spooled materials comprising:

a) an upper half having at least one generally flat, corrugated rest, an upper flange and a label display surface having an interior and an exterior, a rounded upper portion and a substantially planar lower portion tangential to the rounded upper portion;

b) a lower half having a generally flat, corrugated base, at least one end flange and a lower flange having a base-widening edge substantially parallel to and in the same plane as the base, said base-widening edge being sized to impart additional stability to the container when the container is sitting on a surface;

c) a hinge joining the upper half with the lower half; and d) a means for maintaining the upper flange in contact with the end flange so as to define a cavity within the container comprising at least one identation in the upper flange that nests within at least one indentation in the end flange.

13. The container of claim 12 wherein the container is comprised of thermoplastic.

14. The container of claim 13 wherein the thermoplastic is polyethylene terephthalate.

15. The container of claim 13 wherein the thermoplastic is clear.

16. The container of claim 14 wherein the polyethylene terephthalate is clear.

17. The container of claim 12 further comprising a label positioned on the exterior of the label surface.

18. The container of claim 12 wherein the container is comprised of clear thermoplastic and a label is positioned on the interior of the label surface.

19. The container of claim 12 wherein the container is comprised of clear thermoplastic and a label is positioned on the exterior of the label surface.

20. The container of claim 13 wherein the thermoplastic is between approximately 0.012 and 0.022 inches thick.

21. The container of claim 12, wherein the hinge and lower flange are positioned substantially opposite and parallel to each other along a plane that is approximately 45° from vertical.

* * * * *

UNITED STATES PATENT AND TRADEMARK OFFICE

CERTIFICATE OF CORRECTION

PATENT NO. : 5,176,272

DATED : January 5, 1993

INVENTOR(S) : Richard J. Ryan

It is certified that error appears in the above-identified patent and that said Letters Patent is hereby corrected as shown below:

Column 1, line 7, delete "application" and insert --Application--

Column 3, line 37, delete "effective widen" and insert --effectively widens--

Column 4, line 8, delete "changed" and insert --changes--

Column 4, line 28, delete "identification" and insert --indentation--

Column 5, line 8, delete "identation" and insert --indentation--.

Signed and Sealed this

First Day of February, 1994

*Attest:*

Bruce Lehman

BRUCE LEHMAN

*Attesting Officer*

*Commissioner of Patents and Trademarks*